US005333765A

United States Patent [19]

Takizawa

[11] Patent Number: 5,333,765

[45] Date of Patent: Aug. 2, 1994

[54] METHOD OF PLEATING GARMENTS

[75] Inventor: Naoki Takizawa, Tokyo, Japan

[73] Assignee: Kabushiki Kaisha Miyake Design Jimusho, Tokyo, Japan

[21] Appl. No.: 36,146

[22] Filed: Mar. 22, 1993

Related U.S. Application Data

[63] Continuation-in-part of Ser. No. 845,694, Mar. 4, 1992, abandoned.

[30] Foreign Application Priority Data

Aug. 22, 1991 [JP] Japan ..... 3-233768

[51] Int. Cl.[5] ..... A41H 43/00; D06C 3/00; B31B 1/25

[52] U.S. Cl. ..... 223/28; 223/57; 223/37; 223/51; 223/52; 26/69 R; 493/405

[58] Field of Search ..... 223/29, 28, 37, 38, 223/51, 52, 70, 57, 76; 38/69; 2/243 A, 243 B, 243 R; 26/21, 69 R, 69 A; 28/155, 156, 163, 165; 493/405, 411, 417

[56] References Cited

U.S. PATENT DOCUMENTS

| | | |
|---|---|---|
| 2,575,672 | 11/1951 | Miller . |
| 2,676,326 | 4/1954 | Kay . |
| 2,717,779 | 9/1955 | Currie . |
| 3,656,246 | 4/1972 | Lord . |
| 3,738,019 | 6/1973 | Forg et al. . |
| 3,823,452 | 7/1974 | Harrow . |
| 3,987,519 | 10/1976 | Potosnak et al. . |
| 4,576,611 | 3/1986 | Pascoe, Sr. . |
| 4,578,085 | 3/1986 | Ishimaru . |
| 5,042,227 | 8/1991 | Merry . |

FOREIGN PATENT DOCUMENTS

| | | |
|---|---|---|
| 100312 | 2/1898 | Fed. Rep. of Germany . |
| 2823196 | 11/1979 | Fed. Rep. of Germany . |
| 3118380 | 11/1982 | Fed. Rep. of Germany . |
| 3312822 | 10/1984 | Fed. Rep. of Germany . |
| 334223 | 12/1903 | France . |
| 1595185 | 7/1970 | France . |
| 2476705 | 8/1981 | France . |
| 42-12232 | 7/1967 | Japan . |
| 47-23999 | 7/1972 | Japan . |
| 2-269866 | 5/1990 | Japan . |
| 3-167049 | 7/1991 | Japan . |
| 4-23026 | 4/1992 | Japan . |
| 1230570 | 5/1971 | United Kingdom . |

OTHER PUBLICATIONS

George L. Payet, "Almi Set Process a New Approach to Carefree Garments", Apr. 1973, pp. 194–197, Textile Research Journal, vol. 43, No. 4.

*Primary Examiner*—Clifford D. Crowder
*Assistant Examiner*—Bibhu Mohanty
*Attorney, Agent, or Firm*—Frishauf, Holtz, Goodman & Woodward

[57] ABSTRACT

A method of pleating an unfinished garment, wherein an unfinished garment prepared by sewing cloth parts together is folded around a core plate, the unfinished garment, thus folded, is placed in a case. The case containing the folded garment is inserted into a heat-treating apparatus, and the folded garment is simultaneously heat-treating and pleated.

4 Claims, 10 Drawing Sheets

METHOD OF PLEATING GARMENTS

CROSS REFERENCE

This is a continuation-in-part of U.S. patent application Ser. No. 07/845,694 filed on Mar. 4, 1992 now abandoned.

BACKGROUND OF THE INVENTION

1. Field of the Invention

This invention relates to a method of pleating unfinished garments, thereby to manufacture pleated garments such as pleated skirts, pleated dresses, pleated blouses, and pleated slacks.

2. Description of the Prior Art

Methods of manufacturing pleated garments such as pleated skirts, are known. Skirts having pleats are classified into flared skirts, gathered skirts, and pleated skirts. Processes of forming pleats on skirts, dresses, blouses, slacks, and the like are generally called "pleating."

When pleated, the dress attains appropriate shades and has a visual effect, or a specific aesthetic impression. Further, the pleats impart the dress flexibility, which makes the wearer feel not tightened up and enables the wearer to move well, even if the nominal size of the dress is too small for the wearer.

Pleated garments, such as pleated skirts, pleated dresses, pleated blouses, and pleated slacks, are usually manufactured in the following steps in most case:

(1) First, selected cloth is cut into several parts having predetermined shapes and sizes (cutting).

(2) The parts, thus prepared, are pressed in preparation for the next step, i.e., pleating (pressing).

(3) The parts are pleated by a pleating machine or by human labor (pleating).

(4) The pleated parts are placed in a heat-treatment apparatus, and heated with saturated steam, thus fixing the pleats (heat treatment).

(5) The parts, each now having fixed pleats, are pieced together by means of a sewing machine, thereby producing a pleated garment (sewing).

As described above, a pleated garment is produced, usually by first cutting cloth into parts, then pleating cloth parts, and finally sewing these parts together. In some cases, it is made by first pleating cloth, then cutting the pleated cloth into parts, and finally sewing the parts together. Sewing is always done after pleating. In either case, buttons are fixed during the sewing step.

Recently, first cloth parts are sewed together into an unfinished garment, and then the unfinished garment is processed to have pleats. This process of forming pleats on an unfinished garment, which can be called "post pleats process," is disclosed in Published Unexamined Japanese Patent Application 2-269866.

In the post pleats process, first cloth parts are sewed together, and then the resultant unfinished garment is pleated. Hence, the finished product, i.e., the pleated garment has sufficient flexibility, and can have various designs, acquiring different aesthetic impressions.

As pointed out, the conventional method of manufacturing pleated garments comprises many steps, i.e., cutting, pressing, pleating, heat-treating, and sewing. The method further comprises the step of placing the pleated garment in a package case. Much time is required to manufacture pleated garmants by the conventional method. Obviously, the method fails to meet great demand for pleated garments.

Pleating process consists in clamping a cloth part to be sewed to another part, or an unfinished garment (i.e., cloth parts sewed together), between an upper mold having grooves and a lower mold having projections complementary to the grooves of the upper mold. Most upper and lower molds, generally known as "pleats molds," are made of metal. A pair of molds are attached to a pleating machine, which is operated to form pleats on unfinished garments.

Ordinary pleats, or simple pleats, can be formed by the pleating machine equipped with metal pleats molds. Complex pleats, such as tapered-side pleats, accordion pleats, pattern-matching pleats, and the like, cannot be formed by the machine, however. They are formed manually, with assistance of pleats molds made of paper. As well understood, much time is consumed to form complex pleats.

No matter whether pleats are formed by the machine or hand, pleats molds need to be used. Inevitably, pleats can have but limited designs. Consequently, it is difficult to produce garments having pleats of various designs, in large quantities.

To form pleats of any new designed, a pair of pleats molds, i.e., an upper mold and a lower mold, must be prepared. In the case where an unfinished garment needs to be pleated at a time, it is necessary to make an upper mold and a lower mold, either consisting of many mold elements. Needless to say, it takes a long time to prepare such pleats molds, which hinders the prompt large-scale manufacture of pleated garments.

SUMMARY OF THE INVENTION

It is therefore an object of the present invention to provide a method of pleating unfinished garments at high speed, thereby to manufacture garments having various types of pleats.

It is another object of the present invention to provide pleated garments having a visual effect or an aesthetic impression.

To achieve the object, a method according to the present invention comprises the steps of folding a unfinished garment prepared by sewing cloth parts together, around a core plate used in place of pleats molds, placing the unfinished garment, thus folded, in a case, and heating the case and the unfinished garment therein.

When the unfinished garment, folded around the core plate and placed in the case, is heat-treated, pleats extending along the edges of the core plates are formed. Thus, heating and pleating are carried out at the same time.

DETAILED DESCRIPTION OF THE PREFERRED EMBODIMENTS

Embodiments of this invention will now be described in detail, with reference to the accompanying drawings.

Figure 1A:
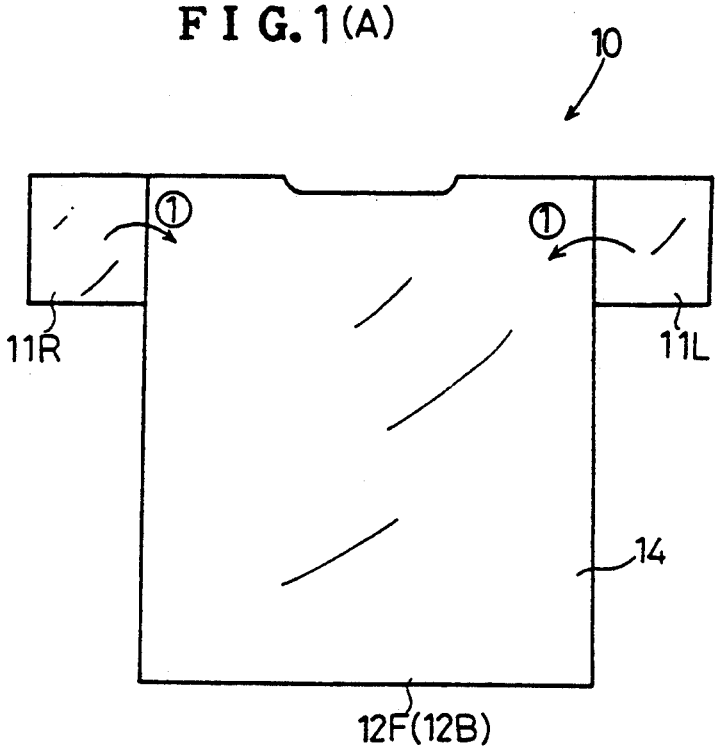
FIGS. 1(A) to 1(H) are diagrams, explaining how an unfinished garment is folded in a specific way.

A method of pleating a T-shirt 10 shown in FIG. 1(A), which is a first embodiment of the present invention, will be described first. Assuming that the T-shirt 10 comprises two sleeve parts 11L and 11R, a front part 12F, and a back part 12B. The T-shirt, or unfinished garment 14, has been produced, first by cutting cloth into two sleeve parts, a front part, and a back part, and then by sewing these parts together at edges by means of a sewing machine.

Figure 1B:
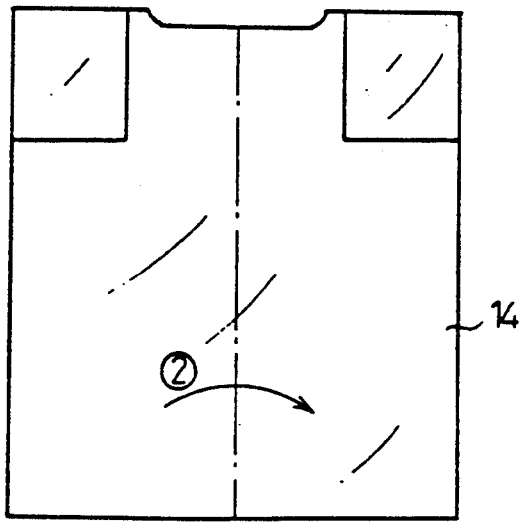

The unfinished garment 14 is first folded a few times and then folded around a core plate. More specifically, as shown by arrow (1) in FIG. 1(A), the left sleeve part 11L and the right sleeve part 11R are folded, placing the sleeve part 11L on the left half of the front part 12F and the sleeve part 11R on the right half of the front 12F. Next, the front part 11F and the back part 11B, which are overlapping, are folded double at the center line, as indicated by arrow (2) in FIG. 1(B).

Figure 1C:
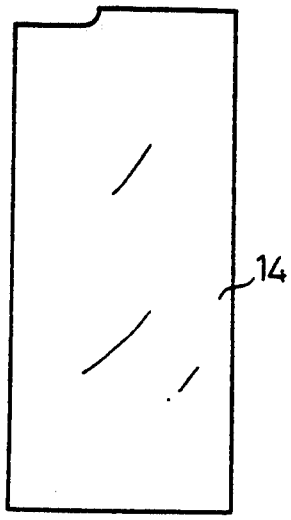
Figure 1D:
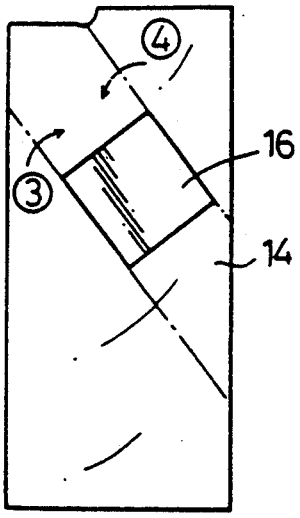

As a result, the unfinished garment 14 is folded in half as illustrated in FIG. 1(C). Then, a core plate 16 is put on the unfinished garment 14 thus folded, at the position specified in FIG. 1(D). A part of the folded garment 14 is folded around one edge of the plate 16 as indicated by arrow (3) in FIG. 1(E), and another part of the folded garment 14 is folded round the opposite edge of the plate 16 as indicated by arrow (4) in FIG. 1(E). Further, the edges of the parts of the garment 14 are bent around onto the back, as specified by arrow (5) in FIG. 1(E). A part of garment 14 thus folded is further folded as is indicated by arrow (6) in FIG. 1(E).

The core plate 16 has a desired shape and a desired size; it is made by cutting a plate of material having appropriate rigidness and air-permeability, such as cardboard. The plate 16 is either square or rectangular in most case, since it is used as a core around which to fold the unfinished garment 14. Nonetheless, it can be pentagonal or can have a similar shape.

Figure 1E:
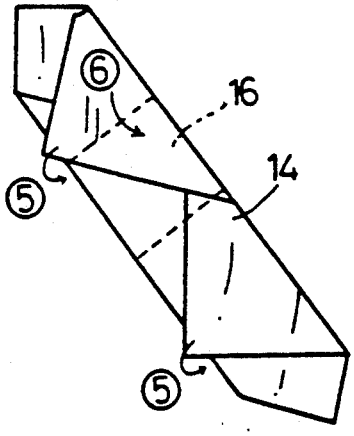
Figure 1F:
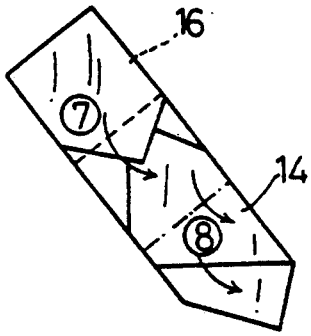
Figure 1G:
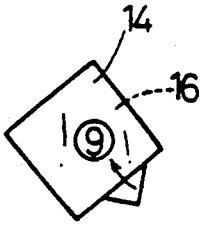
Figure 1H:
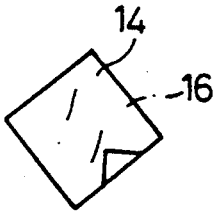

After having been folded as shown in FIG. 1(E), the garment 14 is further folded twice forward, around the core plate 16 as shown by arrows (7) and (8) in FIG. 1(F). Still further, the unfinished garment 14 is folded as indicated by arrow (9) in FIG. 1(G). As a result, the garment 14 is completely folded as shown in FIG. 1(H), wrapping up the core plate 16.

Figure 2:
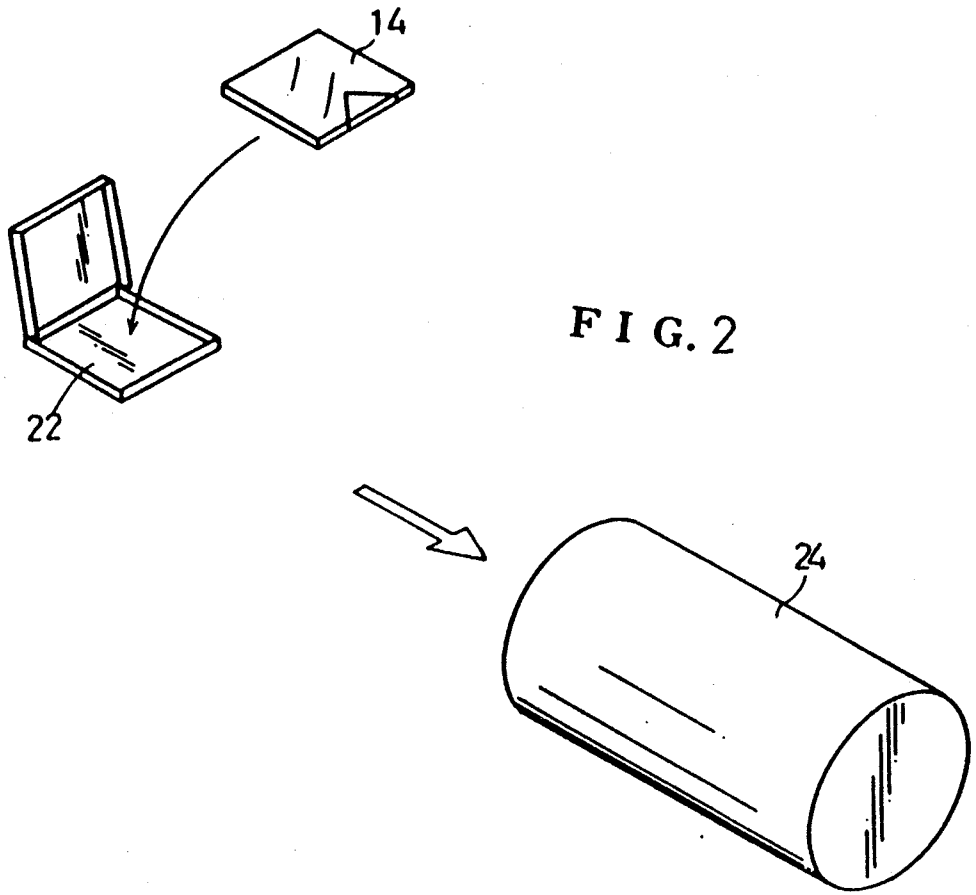
FIG. 2 is a diagram, explaining how the unfinished garment, folded as shown in FIGS. 1(A) to 1(H), is placed in a case, and how the case containing the folded garment is inserted into a heat-treatment apparatus.

Thereafter, the folded garment 14 is placed in a case 22, as shown in FIG. 2. The case 22 is made of air-permeating material such as cardboard, and comprises a base (i.e., a lower half) and a cover (i.e., an upper half). The cover is hinged at one side to the base, and can be locked in its closed position where it covers the base completely. The case 22 has a width and a depth which are so great that the case 22 can contain the whole folded garment 14. The case 22 has such a height that the base and the cover lightly clamp the folded garment 14 as long as the cover is locked in the closed position.

As evident from FIG. 2, the case 22 is a square box. The case 22 can of course be replaced by a case of any other shape. Alternatively, the case 22 can be replaced by a sheet of wrapping paper. In other words, the folded garment 14 can be wrapped with a sheet of wrapping paper, and the resultant wrapping can be tied with a string. Bumping material such as a sponge sheet can be interposed between the cover of the case 22 and the folded garment 14 placed in the case 22. If necessary, the folds of the unfinished garment 14 can be held by pins, clips, or the like, thereby to prevent the folded garment 14 from slackening.

Since the case 22 is shaped as described above, the folded garment 14 is clamped between the base and the cover, thus prevented from loosening. The case 22, which contains the folded garment 14, is inserted into a heat-treating apparatus 24. The heat-treating apparatus 24 is of the known type which is filled with saturated steam. In case of pleating unfinished garment 14 made of polyester, for example, the following processes are adopted:

(1) First, air is evacuated from the interior of the heat-treatment apparatus 24.

(2) The interior of the heat-treatment apparatus 24 is filled with saturated steam of 102° C. and set at substantially 0.2 atmosphere.

(3) The interior of the heat-treatment apparatus 24 is heated to 120° C. and its pressure is increased to 1 atmosphere.

(4) As soon as the temperature and the pressure in the interior of the heat-treatment apparatus 24 have reached 120° C. and 1 atmosphere, respectively, the steam is exhausted from the heat-treatment apparatus 24 until the temperature is lowered to 80° C. It takes about twenty minutes for performing the heat-treating process. Usually, the heat-treating process is continuously done twice for the unfinished garment 24.

Since both the core plate 16 and the case 22 are made of air-permeating material such as cardboard, the steam permeates deep into the folded garment 14. As a result, the unfinished garment 14 comes to have permanent pleats which extend along the edges of the core plate 16. Since the interior of the apparatus 24 is negatively pressurized, the unfinished garment 14 can have sharper pleats.

Figure 3:
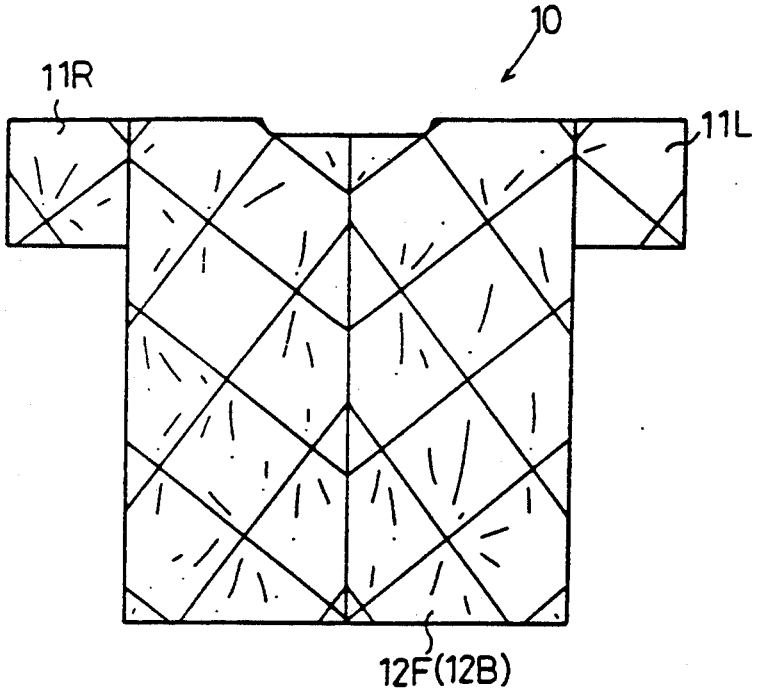
FIG. 3 shows the pleated garment made by unfolding the unfinished garment after the unfinished garment has been heat-treated by the heat-treatment apparatus.

At last, the heat-treated garment 14 is removed from the heat-treating apparatus 24. Then, the folded garment 14 is unfolded, thus obtaining a finished garment 10. As evident from FIG. 3, the finished garment 14 (i.e. the T-shirt 10) has pleats extending along the edges of the core plate 16.

In the conventional pleating process, as has been pointed out, either a cloth part to be sewed to other parts or an unfinished garment is first clamped between an upper mold having grooves and a lower mold having projections, then is pleated, and finally is heat-treated, whereby the cloth part or the garment is permanently pleated.

By contrast, in the present invention, the unfinished garment 14, which is folded around the core plate 16 and placed in the case 22, is heat-treated, whereby forming pleats on the unfinished garment 14, each pleat extending along an edge of the core plate 16. That is, the heat treatment and the pleating are accomplished at the same time in the present invention. The folding of the garment 14, though performed by hand, can be quickly accomplished since the core plate 16 works as a folding guide. Obviously, the method of the invention comprises less steps than the conventional method of pleating garments, and can thus serve to pleat unfinished garments at higher speed. The method according to the invention can, therefore, meet the demand that pleated garments be manufactured in large quantities.

The set of pleats molds, i.e., the upper mold and the lower mold, used in the conventional method, are large and cannot be prepared fast or at low cost. The core plate 16, used in the method of the invention, is much smaller and can be made easily, merely by cutting, for example, cardboard. Hence, the plate 16 can be prepared within a sort time and at low cost. Unlike the pleat molds, the core plate 16 dose not hinder mass-production of pleated garments. In addition, the core plate 16 can be provided in various sizes and shapes with ease.

In the conventional method, cloth parts or unfinished garments are clamped, one by one, between the upper pleat mold and the lower pleat mold. Apparently, the cloth parts or the unfinished garments cannot be pleated at high speed- The pleating step, which is time-consuming, would inevitably reduce the efficiency of the manufacture of pleated garments.

According to the invention, the unfinished garment 14 can be folded around the core plate 14 with ease and at high speed- Since the unfinished garment 14 is pleated at the same time, it is heat-treated, without making it necessary to heat the garment 14 longer than otherwise. Thus, the pleating step makes no bar to high-speed manufacture of pleated garments.

Further, since the pleating step is carried out after the sewing step, the pleats can be designed, not restricted by the conditions of sewing cloth parts together. By using core plates 16 of various sizes and shapes, interchangeably, and by changing the position of the selected core plate 16, the unfinished garment 14 can have an visual effect, or an aesthetic impression. As a result, the garment 14 acquires an added value easily.

Moreover, since the cloth parts are sewed together before they are subjected to the pleating step, the restoring force of the cloth need not be taken into account at all, and the cloth parts need not be pressed while being sewed together. This makes it possible to sew the cloth parts at high speed. Also, since the cloth parts are sewed before they are pleated, they do not overlap greatly. This makes it easier to sew them by a sewing machine than otherwise.

Since the cloth parts are sewed before they are pleated, the garment 14 has sufficient flexibility. Were they sewed together in an unfinished garment, and were the unfinished garment be then pleated, the finished garment could not have such flexibility.

In the method of the invention, once the unfinished garment 14 is pleated, it need no longer be processed in any way whatever. This is because the cloth parts are sewed prior to the pleating step. In addition, the pleated garment 14, still folded, can be removed from the case 22 and inserted into a package case. Alternatively, the case 22 can be used as the package case. If so, no packaging step needs to be carried out, and the case 22, removed from the heat-treating apparatus 24 and containing the pleated garment, can put to sale at once.

Folded compact in the case 22, the pleated garment is quite portable. Further, folded around the core plate 16, the garment dose not get loose at all while being transported.

As has been explained, the core plate 16 can be made at low cost. The plate 16 is so inexpensive that it would not increase the price of the pleated garment even if the garment is sold, with the plate 16 intact. The core plate 16 is nothing more than a throwaway member.

After the pleated garment is worn for some time, the pleats may deform to some extent, and the flexibility of the garment may decrease. If this is the case, the pleats will regain their original shape, and the flexibility of the garment will be restored, only by folding the garment around the core plate 16 and heat-treated.

In the conventional method, cloth parts are clamped between the upper pleat mold and the lower pleat mold. Hence, if the cloth parts have buttons sewed to them before they are subjected to the pleating step, there is the possibility that the buttons are clamped by the pleat molds and subsequently broken. The buttons cannot be sewed to the cloth parts before the pleating step.

according to the present invention, the unfinished garment 14 is folded around the core plate 16 made of, e.g., cardboard. Buttons, if attached to the garment 14, are not broken by an impact, if any, applied from the core plate 16. Rather, the buttons may damage the core plate 16, which dose not matter since the plate 16 is no more than a throwaway member. Hence, buttons can be sewed to the unfinished garment 14 before the garment 14 is subjected to the pleating step. An unfinished garment having buttons can be pleated exactly in the same way as one having no buttons. For the same reason, pockets can be sewed to the garment 14 before the garment 14 is pleated.

It is desirable that an unfinished garment with buttons be folded such that the buttons are exposed and located on the uppermost layer. Also it is desirable that a flat insert be interposed between the uppermost layer and the layer right under the uppermost layer, so that the buttons make depressions in the layers under the insert. If it is difficult to fold the unfinished garment to have the buttons exposed and located on the uppermost layer, two flat inserts should better be interposed, one between the layer having the buttons and the immediately upper layer, and the other between the layer having the buttons and the immediately lower layer. The insert is made of material having appropriate air-permeability, such as cardboard, like the core plate 16 and the case 22.

Figure 4A:
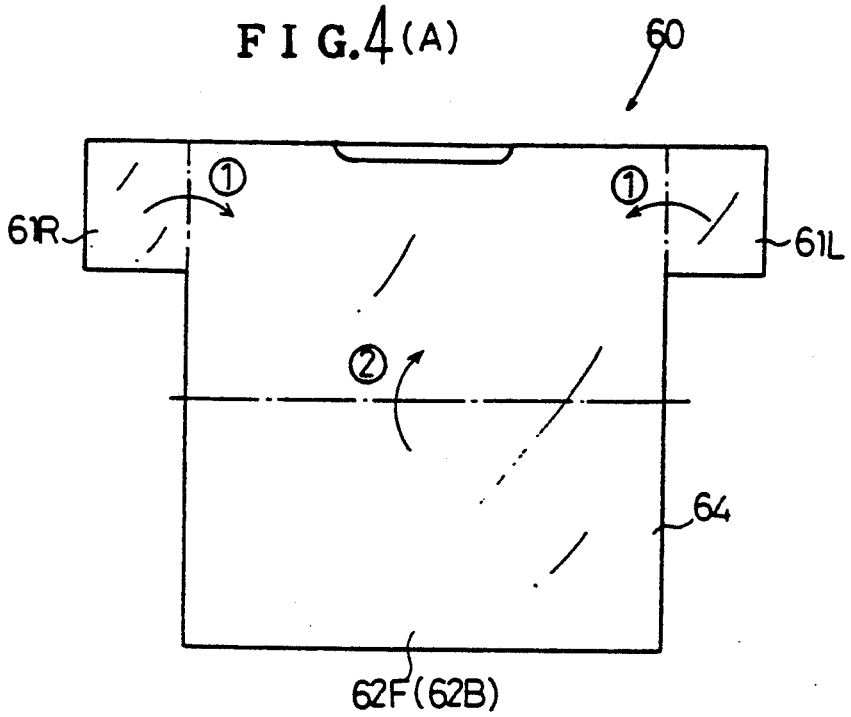
FIGS. 4(A) to 4(F) are diagrams, explaining how an unfinished garment is folded in a different way.

A method of pleating a T-shirt 60 shown in FIG. 4(A), which is a second embodiment of the present invention, will now be described. Assuming that the T-shirt 60 comprises two sleeve parts 61L and 61R, a front part 62F, and a back part 62B. The T-shirt, or unfinished garment 64, has been produced, first by cutting cloth into two sleeve parts, a front part, and a back part, and then by sewing these parts together at edges by means of a sewing machine.

The unfinished garment 64 is first folded a few times and then folded around a core plate. More specifically, as shown in FIG. 4(A), the left sleeve part 61L and the right sleeve part 61R are folded as indicated by arrow ①, placing the sleeve part 61L on the left half of the front part 62F and the sleeve part 61R on the right half of the front part 62F. Next, the front part 62F and the back part 62B, which are overlapping, are folded double at a horizontal line, as indicated by arrow ②.

Figure 4B:
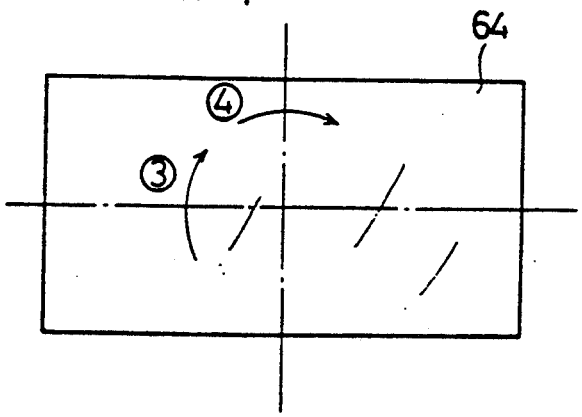
Figure 4C:
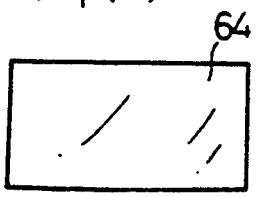

As a result, the unfinished garment 64 is folded in half as illustrated in FIG. 4(B). Then, the garment thus folded, is further folded double at a horizontal line, as indicated by arrow ③, and again folded double at vertical line, as indicated by arrow ④. As a result, the unfinished garment 64 is folded compact as shown in FIG. 4(C) .

Figure 4D:
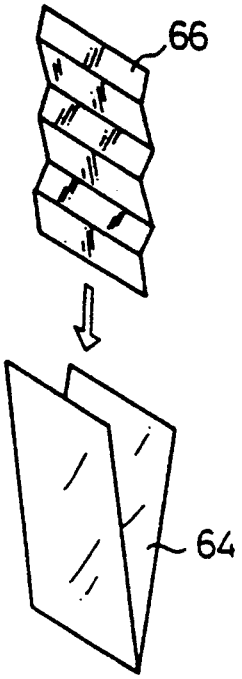
Figure 4E:
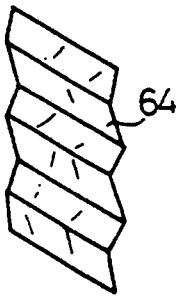
Figure 4F:
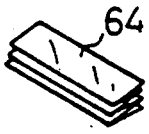

Thereafter, as shown in FIG. 4(D), a core plate 66, which is folded zig-zag, is inserted into the gap between the halves of the folded garment 64 as shown in FIG. 4(D). Then, the zig-zag plate 66 is gradually folded further, whereby the unfinished garment 64 is also folded further, first zig-zag as shown in FIG. 4(E), and then folded compact as shown in FIG. 4(F). Alternatively, the zig-zag core plate 66 can be placed upon or under the folded garment 64, and then be gradually folded further, along with the garment 64.

Figure 5:
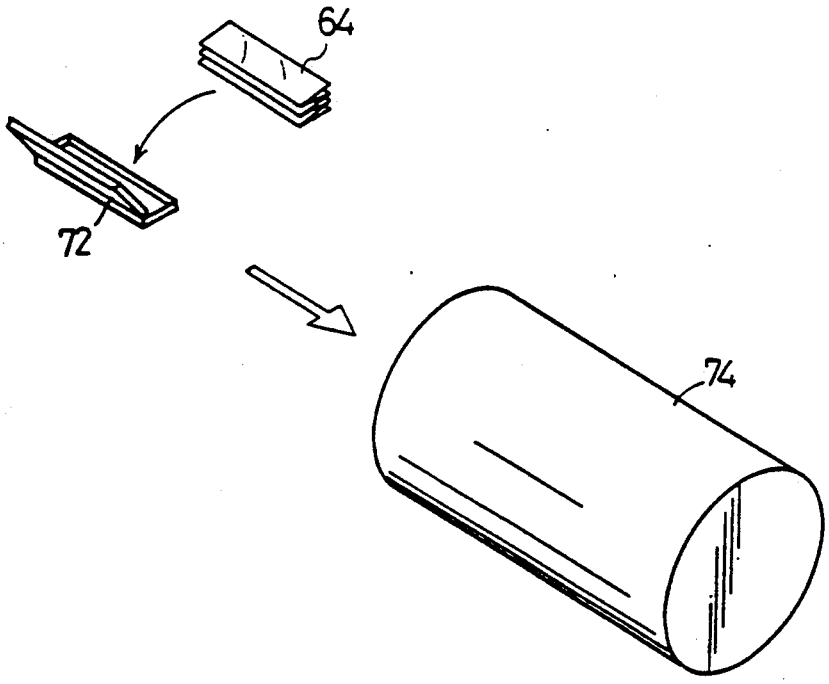
FIG. 5 is a diagram, explaining how the unfinished garment, folded as shown in FIGS. 4(A) to 4(F), is placed in a case, and how the case containing the garment is inserted into a heat-treatment apparatus.
Figure 6:
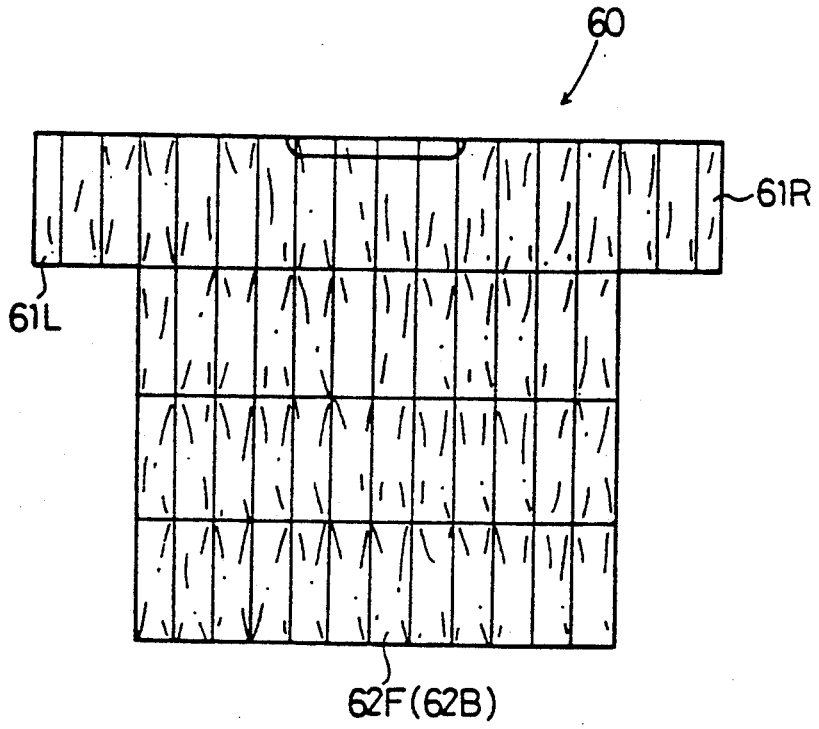
FIG. 6 shows the pleated garment, made by unfolding the unfinished garment shown in FIG. 5 after the unfinished garment has been heat-treated by the heat-treatment apparatus.

As illustrated in FIG. 5, the garment 64, folded compact together with the zig-zag core plate 66, is placed in a case 72, which serves as a package case, too. In the case 72, the folded garment 64 compressed between the base and the cover of the case 72 and, hence, remains folded compact. The case 72 containing the folded garment 64 is inserted into a heat-treating apparatus 74 of the same type as the apparatus 24 shown in FIG. 2.

In the apparatus 74, the unfinished garment 64 is heat-treated in the same way as in the method of the first embodiment. Thereafter, the case 72 is removed from the heat-treating apparatus 74, and the folded garment 84 is removed from the case 72 and unfolded, thus obtaining a finished garment 80. As evident from FIG. 8, the finished garment (i.e. the T-shirt 80) has pleats which were the folds extending along the edges of the core plate 66.

Thanks to the use of the foldable zig-zag core plate 66, the unfinished garment 64 is automatically folded as the plate 66 is folded. No skilled labor is required to fold the garment 64 fast and precisely. Since the parts of the folded garment 64 are clamped among the folds of the zig-zag core plate 66, the garment 64 will have sharp pleats. The plate 66 is made of material having proper air-permeability, such as cardboard, and is therefore far less expensive than the pleat molds used in the conventional method.

In addition, since the case 72 serves as the package case, too, the folded T-shirt 60 can be put to sale at once. Further, since the pleated garment 64 folded, each part clamped between the adjacent two folds of the zig-zag core plate 66, the pleats of the garment 64 do not get loose as long as it is placed in the case 72.

Figure 7C:
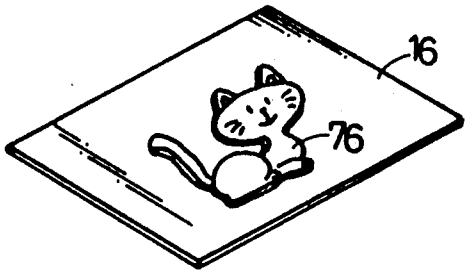
FIGS. 7(A) to 7(C) are diagrams, each showing an auxiliary core plate putting on a core plate.
Figure 7B:
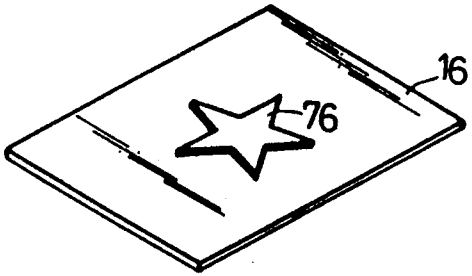
Figure 7A:
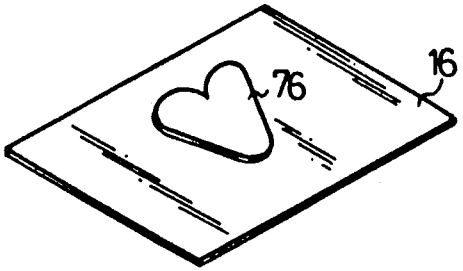

The core plates 16 and 66, and the cases 22 and 72, and the flat inserts can be made of any material other than cardboard, provided the material has appropriate rigidness and proper air-permeability, allowing the passage of saturated steam during the heat treatment:

According to the invention, as shown, FIGS. 7(A) to 7(C) an auxiliary core plate 76, shaped like a heart, a star, a simplified animal figure, or the like, can be put on the core plate 16, and the unfinished garment can be folded around the core plate and on the auxiliary core plate. When the garment thus folded is heat-treated, there will be obtained a pleated garment which has not only pleats but also embosses shaped like a heart, a star, an animal, or the like. The garment, thus produced, gives a specific aesthetic impression which is quite different from those of ordinary pleated garments.

In the embodiments described above, the unfinished garment is a T-shirt. Nonetheless, the method according to the present invention can be employed to manufacture other kinds of pleated garments, such as blouses, skirts, slacks, dresses, and cocktail dresses.

The ways of folding an unfinished garment, described above, are no more than examples. An unfinished garment can be folded in other various ways, merely by changing the position of a core plate.

The present invention is not limited to the embodiments described above. Needless to say, various changes and modification can be made, without departing the spirit and scope of the present invention.

As has been described, in the present invention, an unfinished garment, which is folded around the core plate and placed in the case, is heat-treated to have pleats, each extending along an edge of the core plate. That is, the heat treatment and the pleating are accomplished at the same time in the present invention. Obviously, the method of the present invention comprises less steps than the conventional method of pleating garments, and can thus serve to pleat unfinished garments at higher speed.

Further, the unfinished garment can be folded around the core plate with ease and at high speed. Since the unfinished garment is pleated at the same time it is heat-treated, it need not be heated longer than otherwise. Thus, the pleating step makes no bar to high-speed manufacture of pleated garments.

Further, since the pleating step is carried out after the sewing step, the pleats can be designed, not restricted by the conditions of sewing cloth parts together. By using core plates of various sizes and shapes, interchangeably, and by changing the position of the selected core plate, the unfinished garment can have an visual effect, or an aesthetic impression. As a result, the garment acquires an added value easily.

Moreover, since the cloth parts are sewed together before they are pleated, the restoring force of the cloth need not be taken into account at all. Nor is it necessary to press the cloth parts while being sewed together. This makes it possible to sew the cloth parts at high speed. Also, since the cloth parts are sewed before they are pleated, they do not overlap greatly. It is therefore easy to sew them by a sewing machines.

Since the cloth parts are sewed together before they are pleated, the pleated garment has flexibility as high as is demanded of pleated garments.

Still further, once the unfinished garment is pleated, it need no longer be processed in any way whatever, and can be put to sale. This is because the cloth parts are sewed prior to the pleating step.

Folded compact in the case, the pleated garment can be inserted into a package case right after it is removed from the case. In addition, it is quite portable, and dose not get loose at all while being transported. The core plate is no more than a throwaway member. It can be made at low cost, and is so inexpensive that it would not increase the price of the pleated garment.

The case can be used as the package case, too. If it is so used, no packing step is necessary, and the pleated garment can be put to sale, immediately after it is heat-treated.

Even if the pleats of the garment deform to some extent, and the flexibility of the garment decreases, due to the wearing of the garment for some time, the pleats will regain their original shape, and the garment will regain its flexibility, only by folding the garment around the core plate and heat-treated.

Buttons, if attached to the garment, are not broken by an impact, if any, applied from the core plate. Further, buttons can be sewed to the unfinished garment before the garment is subjected to the pleating step. Also, pockets can be sewed to the garment before the garment is pleated.

Moreover, thanks to the use of the foldable zig-zag core plate, the unfinished garment is automatically folded as the plate is folded. No skilled labor is required to fold the garment fast and precisely. Since the parts of the folded garment are clamped among the folds of the zig-zag core plate, the garment will have sharp pleats. In addition, the pleated can be put to sale at once. Further, since the pleated garment is folded, each part clamped between the adjacent two folds or the zig-zag core plate, the pleats of the garment do not get loose as long as it is placed in the case

What is claimed is:

1. A method of pleating an unfinished garment, comprising the steps of:

folding a sewed unfinished garment around a core plate made of material having rigidness and air-permeability;

placing the folded unfinished garment in a case made of material having rigidness and air-permeability;

inserting the case containing the folded garment into a heat-treatment apparatus filled with saturated steam; and unfinished simultaneously heat-treating and pleating the folded unfinished garment in the heat-treatment apparatus filled with saturated steam which permeates deep into the folded garment through the case and the core plate, thereby pleating the garment.

2. The method according to claim 1, wherein the case is a package case.

3. The method according to claim 1, wherein the sewed unfinished garment is folded around the core plate on which an auxiliary core plate is placed.

4. The method according to claim 2, wherein the sewed unfinished garment is folded around the core plate on which an auxiliary core plate is placed.

* * * * *